United States Patent [19]

Hasler

[11] 4,085,304

[45] Apr. 18, 1978

[54] VIBRATION SWITCH HAVING THREADED TERMINALS AND PLURAL ROLLER CONTACTS

[75] Inventor: William Sandford Hasler, Blackburn, England

[73] Assignee: Shorrock Developments Limited, Blackburn, England

[21] Appl. No.: 714,107

[22] Filed: Aug. 13, 1976

[51] Int. Cl.[2] ..... H01H 35/00

[52] U.S. Cl. ..... 200/61.45 R; 200/61.52; 200/277; 200/61.93

[58] Field of Search ..... 200/61.45 R, 61.45 M, 200/61.52, 277, DIG. 29, 61.93

[56] References Cited

U.S. PATENT DOCUMENTS

| | | | |
|---|---|---|---|
| 2,206,094 | 7/1940 | Hobbs | 200/61.52 X |
| 2,793,260 | 5/1957 | Ciosek | 200/61.45 R |
| 2,794,084 | 5/1957 | Segoni | 200/61.52 |
| 2,898,416 | 8/1959 | Clurman | 200/61.52 X |
| 2,963,562 | 12/1960 | Mishler | 200/61.45 R |
| 3,108,252 | 10/1963 | Torres | 200/61.52 X |
| 3,161,737 | 12/1964 | Hall | 200/61.52 |
| 3,161,738 | 12/1964 | Hall | 200/61.52 |
| 3,217,120 | 11/1965 | Bowen et al. | 200/61.52 |
| 3,935,669 | 2/1976 | Potrzuski et al. | 200/61.45 R X |
| 4,025,744 | 5/1977 | Kniskern | 200/61.45 R |

FOREIGN PATENT DOCUMENTS

| | | | |
|---|---|---|---|
| 580,319 | 4/1931 | Germany | 200/61.52 |
| 1,162,994 | 9/1969 | United Kingdom. | |
| 1,263,076 | 2/1972 | United Kingdom. | |

*Primary Examiner*—James R. Scott
*Attorney, Agent, or Firm*—Ross, Ross & Flavin

[57] ABSTRACT

Two side-by-side elongate terminals support, from below, one or a pair of electrically-conducting bodies which contact the terminals and thus provide electrical continuity between the terminals so that vibration will cause the body or bodies to lift from one or both of the terminals and break the continuity.

4 Claims, 3 Drawing Figures

VIBRATION SWITCH HAVING THREADED TERMINALS AND PLURAL ROLLER CONTACTS

BACKGROUND OF THE INVENTION

This invention concerns vibration switches, that is to say electrical switches of the kind which are actuated by vibration or impact and which are used, for example, as intruder alarm switches.

SUMMARY OF THE INVENTION

An object of the invention is to provide a novel construction for such a switch which, in its preferred embodiment, will not normally be subject to fortuitous actuation, so that where such a switch is embodied in an intruder alarm, the risk of false alarms arising therefrom is minimised.

With this object in view the present invention provides a vibration switch comprising a side-by-side pair of elongate electrically-conductive terminals and an electrically-conductive loose body the size and/or shape of which is such that the body cannot pass through the gap between the terminals which serve, when in a horizontal or near-horizontal disposition, to support the body from below so that the body provides for electrical continuity between the terminals.

The switch preferably includes a second electrically-conductive loose body, the arrangement being such that the two said bodies are supported by respective portions of the terminals so that electrical discontinuity occurs between the terminals only upon simultaneous contact-breaking movement of both the bodies.

Each body may, for example, be of regular prismatic configuration. Preferably, however, it is in the form of a cylinder or roller.

The terminals may be of rod-like form; they are preferably circumferentially-grooved or corrugated to ensure reliable contact with the body or bodies, in which case they may be in the form of threaded rods or screws.

In the case where there are two said bodies, insulating spacers may be provided on one or both of the terminals to define the respective portions thereof for the two bodies.

The body or bodies and/or the terminals are preferably plated with a good electrically-conducting material such as gold.

The switch of the invention preferably includes a housing which so surrounds the terminals and the body or bodies that the latter, upon being separated from the terminals, will fall back to their positions supported by the terminals. This housing may conveniently be of cylindrical form including an end closure into which the terminals are secured.

The arrangement preferably includes a mounting into which the switch casing may be fitted in any selected one of four different angularly-orientated positions.

BRIEF DESCRIPTION OF THE DRAWING

The invention will be described further, by way of example, with reference to the accompanying drawing, in which.

DESCRIPTION OF THE PREFERRED EMBODIMENTS

Figure 1:
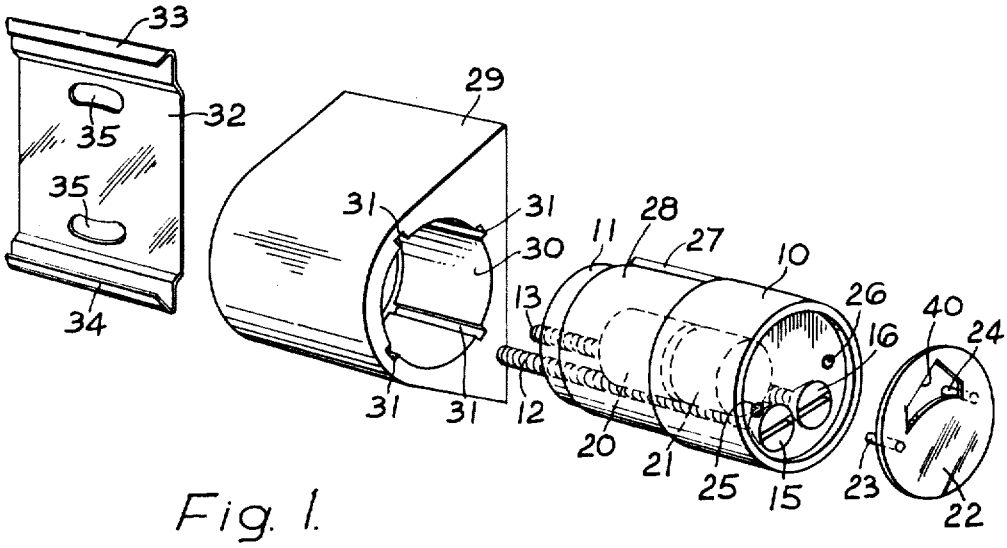
FIG. 1 is an exploded perspective view illustrating a preferred embodiment of the vibration switch of the invention.

As can be seen from the drawing, the preferred embodiment of the vibration switch of the invention comprises a housing 10 of insulating material, generally of cylindrical configuration, and including a separately-formed end closure disc 11 which is a plug-in fit into the housing and may be cemented in place.

Figure 2:
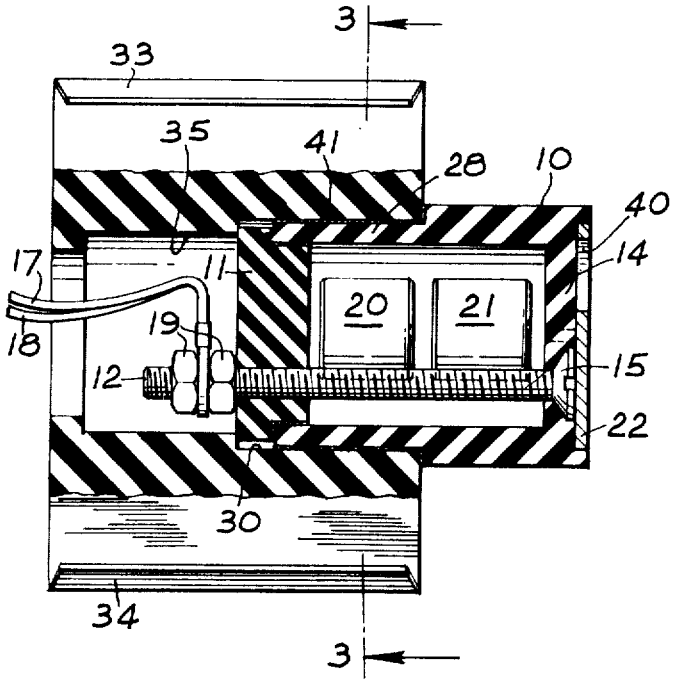
FIG. 2 is a sectional elevation illustrating the vibration switch of FIG. 1 in its assembled condition.
Figure 3:
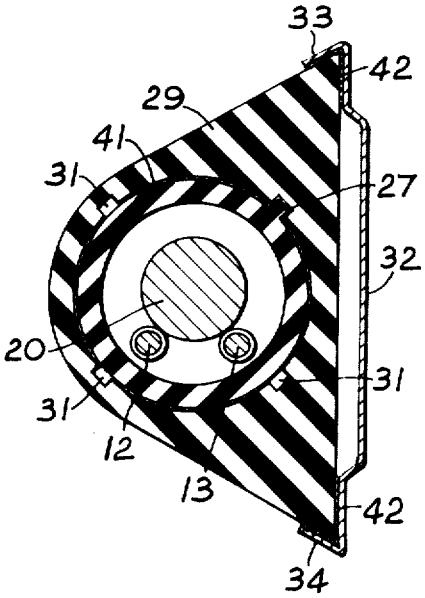
FIG. 3 is a section taken on line 3—3 of FIG. 2.

Secured to an integral end closure 14 of the housing 10, by one end thereof being engaged in respective holes therein, and further located in the closure disc 11 by respective ends thereof extending through respective holes therein, are two elongate electrically-conductive terminals 12, 13 each of which is in the form of a relatively long screw. The terminals 12, 13 are of such a length that, when in position in the said holes in the end closure 14 and the disc 11 with their heads 15, 16 abutting against the end closure 14, sufficient thereof protrudes for respective leads 17, 18 to be secured thereto by respective nuts 19, as can be seen in FIG. 2.

Carried by the terminals 12, 13 are two electrically-conducting bodies 20, 21 each in the form of a metal roller which is externally plated with a coating of good electrically-conducting material, such as gold.

The switch housing end closure 14 has a recess to accommodate a disc 22 which is attached to the end closure 14 by means of pegs 23, 24 which are formed integrally with the disc 22 and engage in respective holes 25, 26 in the end closure 14. The disc 22 has in it an arrowhead 40 which serves to indicate which way the switch should be mounted, in order to ensure that the terminals 12, 13 support the bodies 20, 21 from below. Normally the switch will be assembled so that the arrowhead 40 points vertically upwards.

Substantially midway along the length of the housing 10, the latter is stepped down to define a smaller diameter portion 28 and there is a ridge 27 along said smaller diameter portion 28.

Complementary to the switch housing 10 is a mounting block 29 through which extends a hole of three separate diameters, thereby providing a largest diameter section 30 for the switch housing 10 to fit snugly therein.

The section 30 is formed with four grooves 31 extending substantially parallel to the axis of the hole, each said groove 31 being sufficient in size to permit the raised ridge 27, on the outside of the housing 10, to enter therein. The grooves 31 accordingly permit the switch housing 10 to be fitted into the mounting block 29 in any selected one of four different angularly-rotated orientations.

Smaller diameter section 35 of the hole through the mounting block 29 leaves sufficient space for the leads 17, 18 to be secured to the terminals 12, 13.

As can be seen from the various figures, also provided is a bracket 32 whereby the switch can be fixed in any desired location. The mounting block 29 can be fitted into the bracket 32 by being slid into the latter so that two opposite edges thereof locate under two angled edges 33, 34 on the bracket 32. The bracket 32 may be fixed by means of screws (not shown) through holes 35 therein.

When the switch housing 10 is mounted so that the terminals 12, 13 are substantially horizontal and side-by-side, the two rollers 20, 21 (which constitute bodies of shape and/or size such that they cannot pass through the gap between the terminals 12, 13) are each supported from below by the terminals 12, 13.

The switch housing 10 may be made fast in the mounting block 29 with adhesive as indicated at 41 and similarly the mounting block 29 may be made fast to the bracket 32 with adhesive, e.g. at the angled edges 33 and 34, as indicated at 42.

In practical use of the switch, for example as an intruder alarm switch in an intruder alarm system, the switch is mounted in a location such that it will be subjected to vibration or impact by any person seeking to gain unauthorised access via the location. As already mentioned, the switch housing 10 may be fitted in any selected one of four angularly-oriented orientations; thus it will readily be appreciated that the switch can be mounted on a floor, wall (left-handed or right-handed) or ceiling, as desired, using an appropriate orientation of the housing 10 in the mounting block 29.

It will readily be understood that the mounting of the switch should preferably be such that the axes of the terminals 12, 13 and rollers 20, 21 are substantially parallel to the direction in which vibration is likely to occur, in order to ensure maximum sensitivity of the switch.

Now, in the event of the switch being subjected to vibrations or impact, e.g. as a result of a blow or blows being made on the panel or adjacent structure, both of the rollers 20 and 21 will be caused to lift from one or both of the terminals 12, 13 simultaneously, even if only for extremely minute periods of time of the order of fractions of microseconds, thereby to cause corresponding interruption of current flow between the leads 17 and 18 and to initiate the operation of an alarm of the intruder alarm system.

The switch casing 10 surrounds the body or bodies 20, 21 so that upon the body or bodies 20, 21 being separated from the terminals 12, 13, the bodies 20, 21 will fall back to their positions supported by the terminals 12, 13.

In this described embodiment, considerable operational reliability is obtained by reason of the presence of the two rollers 20, 21 which have both to break the electrical continuity between the terminals 12 and 13 for the switch to have been actuated. Vibration switches having only one electrically-conducting body which is vibration- or impact-displaced to actuate the switch are notoriously prone to produce false alarms, as a result of fortuitous interruption of the current through the switch for no apparent reason, and the likelihood of this occurring with the arrangement having the two bodies is extremely low. However, this is not to mean that the present invention is restricted to arrangements having two such bodies, since there are many practical applications where the arrangement substantially as described, but with only one of the rollers, would be of practical utility.

Other variations are possible. Thus, for example, the bodies 20, 21 and/or the terminals 12, 13 need not be gold plated, provided the external surfaces thereof are such that adequate current continuity will occur between the bodies 20, 21 and the terminals 12, 13 when the bodies 20, 21 are simply resting thereon. The threads assist this in the described case, and of course it will be understood that circumferential grooves or corrugations or other formations such as knurling can be provided around the terminals 12, 13 in the place of the threads, for the same purpose. Also, of course, it will be understood that the terminals 12, 13 could be plain rods or strips, with the rollers 20, 21 threaded, corrugated or knurled if desired.

Bodies of form other than cylindrical rollers can be provided in the place of the rollers 20, 21. For instance, they could be prisms of regular polygonal cross-section.

It will be understood that while it is desirable that the terminals 12, 13 should be substantially horizontal and parallel to one another, other side-by-side arrangements which may be horizontal or deviate slightly from the horizontal while still providing support from underneath of bodies resting thereon are possible. For instance, in the event of the terminals converging or diverging, the bodies might, with advantage, be of frustoconical configuration.

Other shapes are possible for the housing of the switch, which housing should, of course, serve to retain the loose bodies, provided by the rollers 20, 21 which will, when the switch is in the disposition illustrated in the drawing, naturally gravitate to their positions supported from below by the substantially-horizontal terminals 12, 13.

The terminals may have insulating spacers provided along their lengths to define respective position or positions for the body or bodies thereon.

I claim:

1. A vibration switch comprising, a housing, a side-by-side pair of substantially parallel, horizontally-disposed, elongate, electrically-conductive terminals supported within the housing, the terminals being of a configuration such as to present, upwardly, a plurality of discrete spaced-apart points and supporting from below a pair of loose, cylindrical, aligned, electrically-conductive bodies which partly occupy a space within the housing above the terminals, the terminals being spaced-apart by a distance such that the bodies cannot drop through and being respectively spaced away from the nearest adjacent part of the housing by a distance such that the bodies, if shaken out of contact with the terminals, cannot fall below the terminals but will fall back to be supported by the terminals.

2. A vibration switch according to claim 1, wherein the housing is cylindrical and includes an integral end wall at one end thereof and an end closure disc at the opposite end thereof, the terminals passing through the end wall and the end closure disc.

3. A vibration switch according to claim 2, wherein the terminals are threaded screws having their heads recessed in the integral end wall of the housing, the screw heads being masked off by the end closure disc.

4. A vibration switch according to claim 1, including a mounting for receiving the housing, the mounting having spaced interior grooves therein, an exterior ridge on the housing receivable in any selected one of the grooves for determining the horizontal side-by-side disposition of the terminals.

* * * * *